US007252185B2

(12) United States Patent
Fujita et al.

(10) Patent No.: US 7,252,185 B2
(45) Date of Patent: Aug. 7, 2007

(54) BILL RECEIVING AND PAYING APPARATUS

(75) Inventors: Junji Fujita, Nagoya (JP); Riichi Katou, Nagoya (JP); Yasutomo Kosugi, Seto (JP); Masanori Terao, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 233 days.

(21) Appl. No.: 11/003,741

(22) Filed: Dec. 6, 2004

(65) Prior Publication Data

US 2005/0189266 A1 Sep. 1, 2005

(30) Foreign Application Priority Data

Jan. 23, 2004 (JP) ..... 2004-015118

(51) Int. Cl.
*G07F 9/10* (2006.01)
*G07F 7/04* (2006.01)

(52) U.S. Cl. ..... 194/350; 194/206

(58) Field of Classification Search ..... 194/350, 194/302, 205, 206; 902/8, 9, 11–15
See application file for complete search history.

(56) References Cited

U.S. PATENT DOCUMENTS 4,479,049 A * 10/1984 Hirose ..... 235/379

FOREIGN PATENT DOCUMENTS

JP 07-267513 10/1995
JP 2003-208654 7/2003

* cited by examiner

*Primary Examiner*—Patrick Mackey
*Assistant Examiner*—Mark J. Beauchaine
(74) *Attorney, Agent, or Firm*—Antonelli, Terry, Stout & Kraus, LLP.

(57) ABSTRACT

The invention provides a bill receiving and paying apparatus which has a function capable of replenishing and retracting the bill in correspondence to a lot of money kinds, secures the bill capacity without enlarging the apparatus, and has an improved maintenance characteristic and an improved operability. A recycle cassette per a money kind and a reject cassette are arranged in parallel in a depth direction as seen from a front face of a bill receiving and paying apparatus, a replenishment/retract cassette is arranged in a vertically laminated direction with respect to the recycle cassette and the reject cassette, the reject cassette is arranged in a front face side or a rear face side of the recycle cassette in correspondence to an operation and maintenance aspect of the apparatus. Further, a bill carrying path arranged in a front side of the replenishment/retract cassette is structured such as to be freely opened and closed, thereby being detachable from the front face side of the replenishment/retract cassette. Further, the bill receiving portion structured by the replenishment/retract cassette and the reject cassette, and the carrying path which may be freely opened and closed, are connected by one two-way carrying path.

19 Claims, 14 Drawing Sheets

BILL RECEIVING AND PAYING APPARATUS

This application claims the benefit of priority of Japanese Application No. 2004-015118 filed on Jan. 23, 2004, the disclosure of which also is entirely incorporated herein by reference.

BACKGROUND OF THE INVENTION

The present invention relates to a bill receiving and paying apparatus, and more particularly to a technology for making it easy to add a recycle cassette and securing a bill capacity in correspondence to an increase of a kind of the received and paid bill without enlarging the apparatus.

As a conventional bill receiving and paying apparatus, JP-A-2003-208654 discloses a bill receiving and paying apparatus comprising:

a cash slot charging and receiving the bill;

a validator validating the bill;

a money classifying recycle cassette receiving the received bill and preparing for the next paying;

a replenishment/retract cassette replenishing the bill in the money classifying recycle cassette in a lump or retracting the bill received in the money classifying recycle cassette in a lump;

a reject cassette removing and accumulating the bill which is determined by the validator to be impossible to read and the bill which is determined to be impossible to be carried;

a temporary stacker temporarily receiving the bill at a time of receiving the bill and the reject bill at a time of paying the bill; and a bill conveying path connecting the cash slot, the validator, the money classifying recycle cassette, the reject cassette and the temporary stacker, wherein the recycle cassette, the reject cassette and the replenishment/retract cassette have a horizontally arranged structure, and are arranged in a vertically laminated direction. Further, as the other bill receiving and paying apparatus, JP-A-7-267513 discloses a bill receiving and paying apparatus in which vertically arranged stackers are arranged in parallel in a depth direction, and no replenishment/retract cassette is arranged.

SUMMARY OF THE INVENTION

In the bill receiving and paying apparatus shown in JP-A-2003-208654 mentioned above, since the replenishment/retract cassette and the reject cassette have the horizontally arranged structure, the cassettes may be attached and detached from a front side or a rear side of the apparatus, and are excellent in maintenance and operation characteristics. However, since the recycle cassette is piled up to the above in correspondence to an increase of the money kinds handled by the apparatus, a height of an entire of the apparatus or the cash slot is increased, so that there is generated a problem that the apparatus may not be installed and there is generated a problem that an operability of the user is lowered.

Further, since the reject cassette has the horizontally arranged structure, and is arranged, in the vertically laminated direction in the same manner as the money classifying recycle cassette, the reject cassette tends to be affected by the height limitation of the cash slot, and there is a possibility that it is unavoidable to structure the reject cassette in a small capacity. In the case that the capacity of the reject cassette is small, there is a problem that the apparatus is down due to the reject cassette being filled with the reject bill.

Further, as shown in JP-A-7-267513, since the structure is made such that the vertically arranged stacker and the retract box may be added in parallel in the depth direction in correspondence to the increase of the money kind, however, the replenishment/retract cassette is not arranged, there is an advantage that the stacker may be added in correspondence to the increase of the money kind, however, since it is necessary to replenish and retract the bill per the stacker by drawing out a whole of a receiving portion structured by the stacker and the retract box from the bill receiving and paying apparatus at a time of replenishing and retracting work, there is a problem that an operation efficiency of the apparatus is deteriorated very much. Further, since the bill carrying portion constituted by a money receiving slot, a money paying slot, a bill identifying apparatus and a temporary storing portion temporarily storing the bill for returning and loading, and the bill receiving portion constituted by the stacker and the retract box are connected by a plurality of carrying path, a jam tends to be generated. Further, since a lot of time is required for a recovery work at a time when the jam is generated, a maintenance characteristic is deteriorated. Further, there is a problem that the apparatus is made large in size due to a plurality of carrying paths.

In order to solve at least a part of the problem mentioned above, in accordance with the present invention, there is provided a bill receiving and paying apparatus, in which the recycle cassette per the money kind has a vertically arranged structure accumulating the bill in a horizontal attitude, the replenishment/retract cassette has a horizontally arranged structure accumulating the bill, the recycle cassette per the money kind and the reject cassette are arranged in parallel in the depth direction as seen from the front face of the bill receiving and paying apparatus, and the replenishment/retract cassette is arranged in the vertically laminated direction with respect to the recycle cassette and the reject cassette. Further, the reject cassette is arranged in a front face side or a rear face side of the recycle cassette in correspondence to an operation and maintenance aspect of the apparatus. Further, the bill carrying path arranged in a front side of the replenishment/retract cassette is structured such as to be freely opened and closed, thereby being detachable from the front face side of the replenishment/retract cassette. Further, the bill receiving portion structured by the replenishment/retract cassette and the reject cassette, and the carrying path which may be freely opened and closed, are connected by one two-way carrying path.

In accordance with the present invention, it is possible to provide a bill receiving and paying apparatus which has a function capable of replenishing and retracting the bill in correspondence to a lot of money kinds, secures the bill capacity without enlarging the apparatus, and has an improved maintenance characteristic and an improved operability.

Other objects, features and advantages of the invention will become apparent from the following description of the embodiments of the invention taken in conjunction with the accompanying drawings.

DESCRIPTION OF THE EMBODIMENTS

A description will be given below of embodiments in accordance with the present technique.

Embodiment 1

A description will be given below of an embodiment of a bill receiving and paying apparatus (also called as a bill handling apparatus) with reference to the accompanying drawings.

Figure 1:
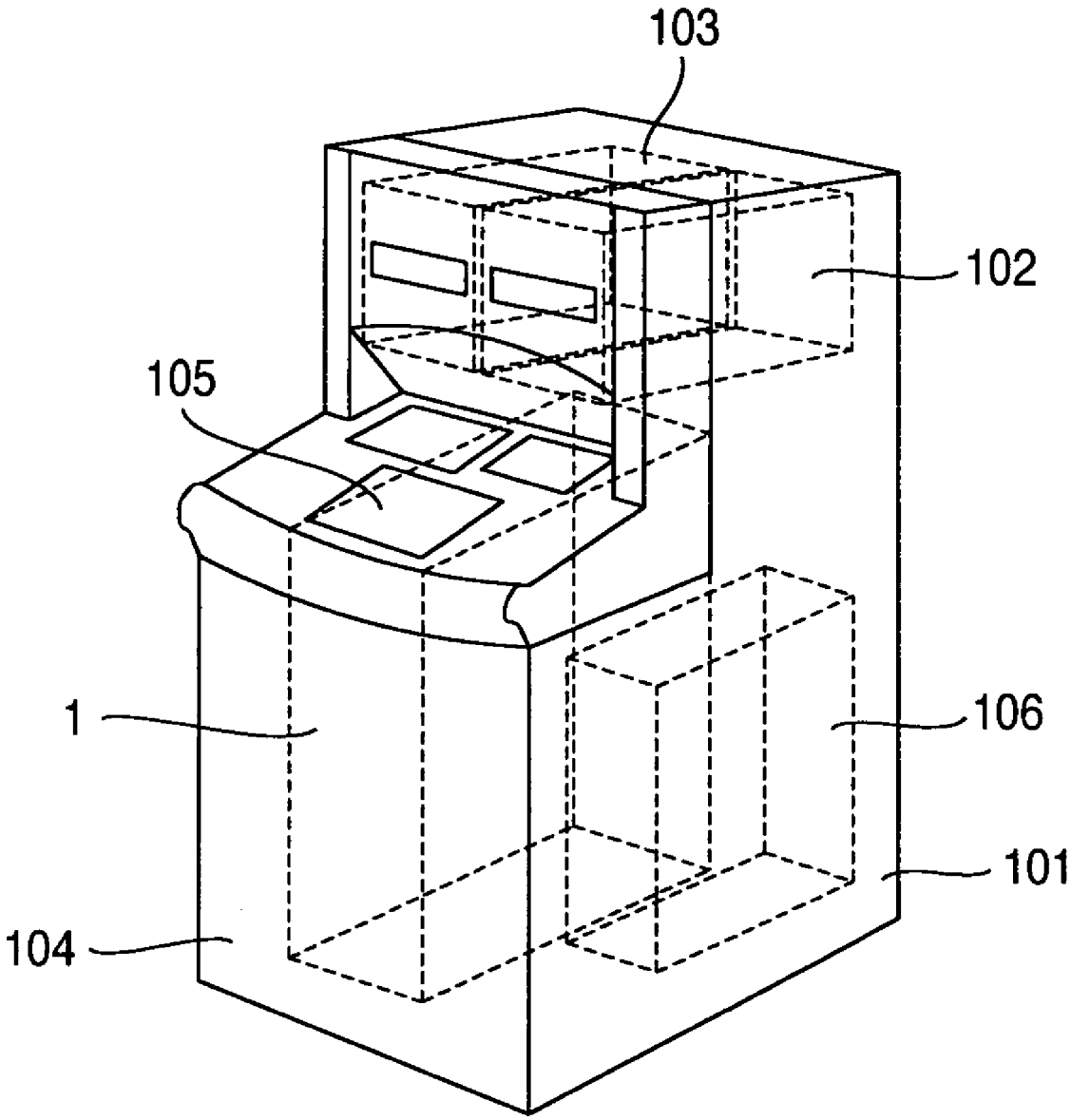
FIG. 1 is a perspective view showing an outer appearance of an embodiment of a cash automatic transaction apparatus.

FIG. 1 shows an outer appearance of an automatic teller machine (ATM) mounting a bill receiving and paying apparatus therein. A constituting element of the automatic teller machine 101 includes a card/account handling mechanism 102 handling a transaction card of a user and a transaction account, a passbook handling mechanism 103 handling a passbook, a casing 104 covering the apparatus, a user operating portion (also called simply as an operating portion) 105 displaying and inputting information necessary for the transaction, and a bill receiving and paying apparatus 1 receiving and paying the bill.

Figure 2:
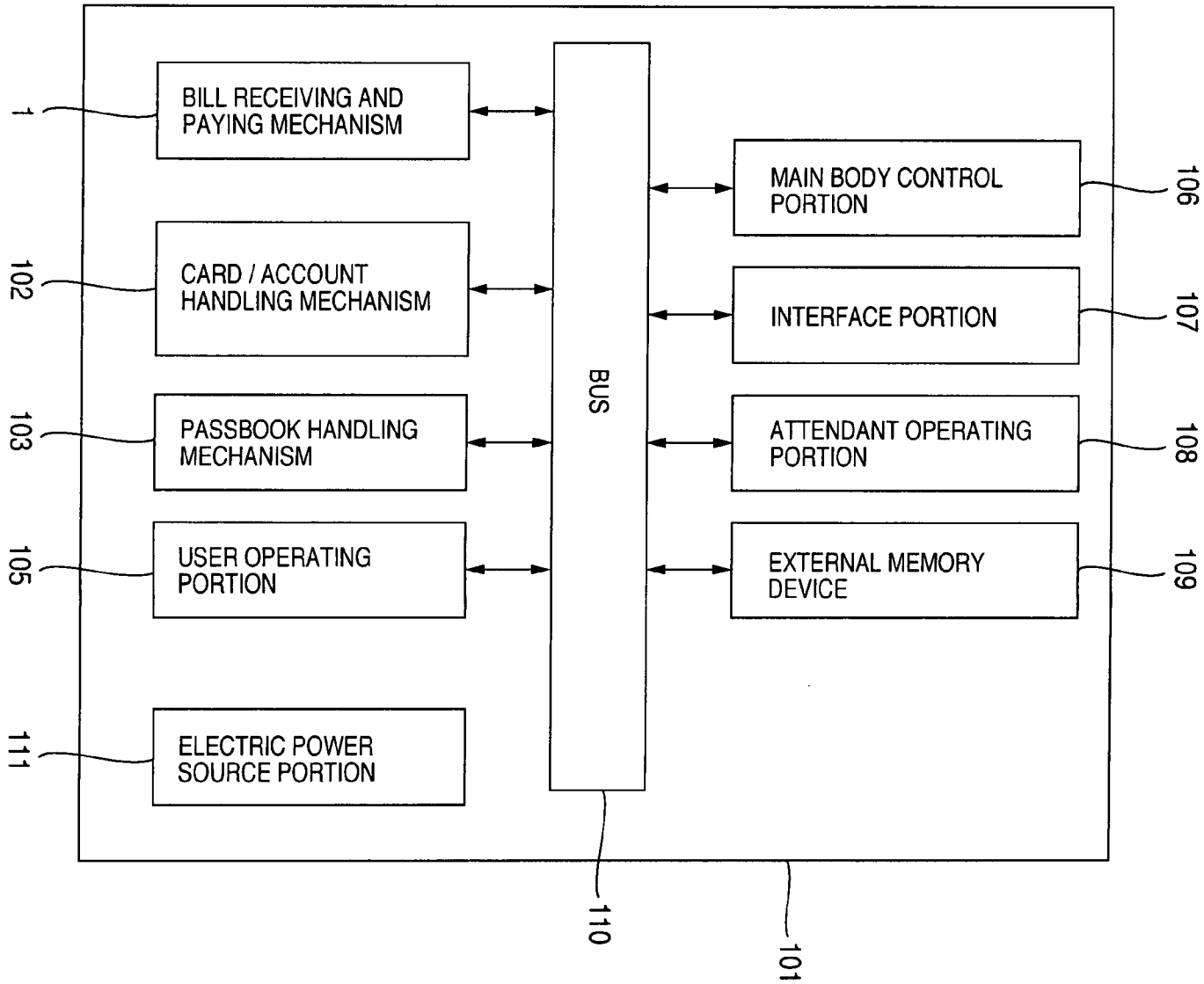
FIG. 2 is a view showing a control mechanism of the embodiment of the cash automatic transaction apparatus.

FIG. 2 is a block diagram showing a control relation of the automatic teller machine 101. The card/account handling mechanism 102, the passbook handling mechanism 103, the user operating portion 105, and the bill receiving and paying apparatus 1 are connected to a main body control portion 106 via a bus 110, and a necessary motion is executed on the basis of a control instruction of the main body control portion 106. In addition to the elements mentioned above, an interface portion 107 for connecting an external unit to the apparatus, a staff operating portion 108 which a staff operates and executes input and output operations of various information to, and an external memory device 109 are connected by a bus 110, thereby giving and taking necessary data. An electric power is supplied to the respective mechanisms and constituting elements shown above by an electric power source 111.

Figure 3:
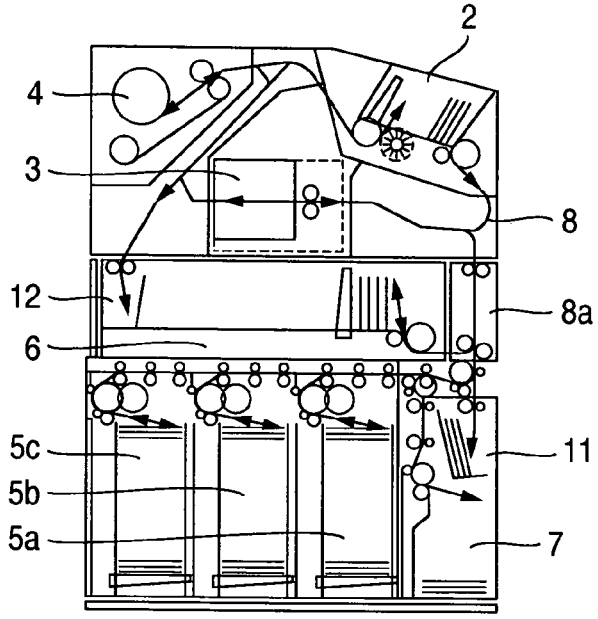
FIG. 3 is a view showing a structure of a bill receiving and paying apparatus.
Figure 6:
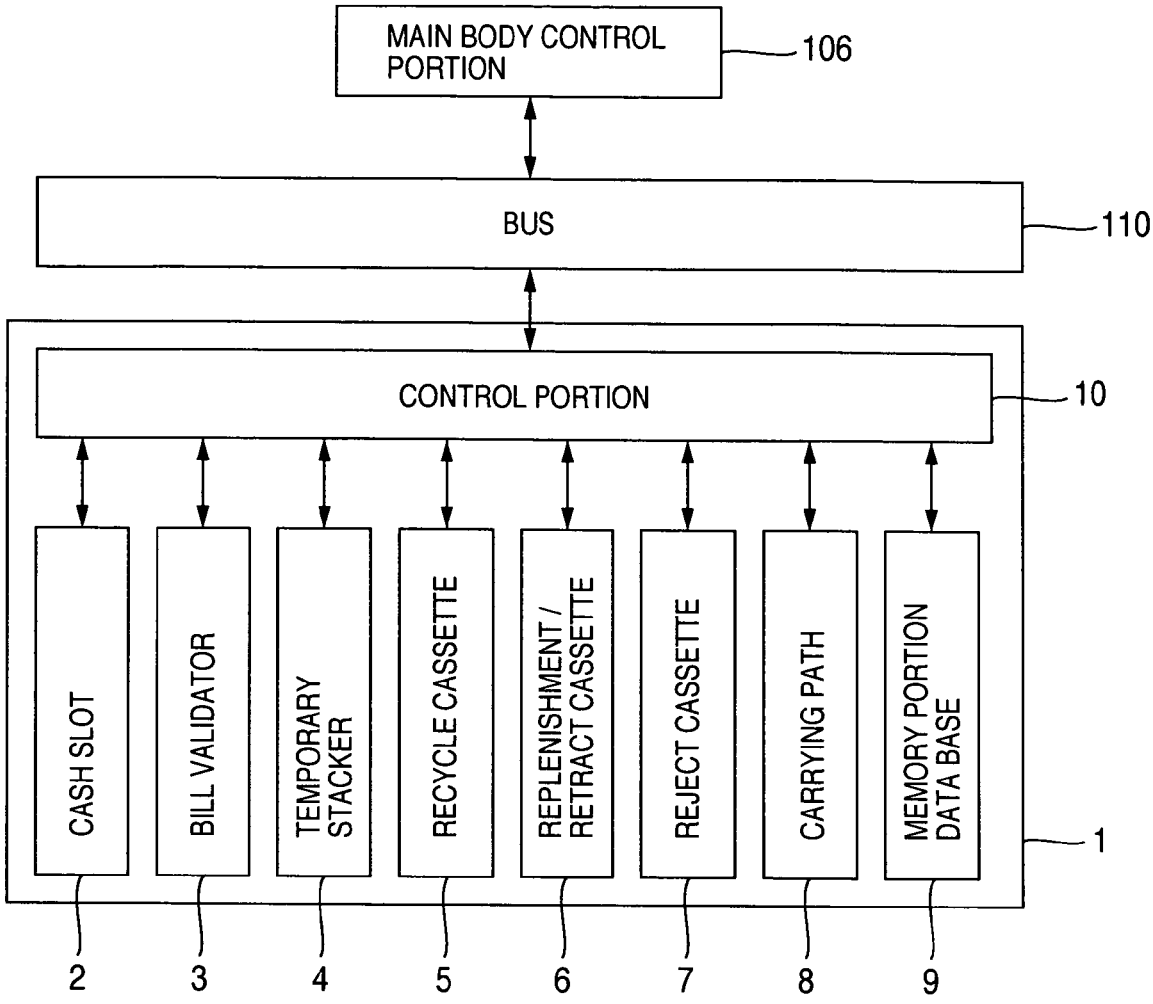
FIG. 6 is a view showing a control mechanism of the bill receiving and paying apparatus.

FIG. 3 is a view showing a structure of the bill receiving and paying apparatus 1 mounted in the automatic teller machine 101, and FIG. 6 is a view showing a control mechanism including a structure of a recycle cassette 5 and the like. The bill receiving and paying apparatus 1 has a cash slot 2 taking in and out the bill, a bill validator (also called simply as a validator) 3 validating a money kind and a carried state of the bill, a temporary stacker (a temporary storage portion) 4 temporarily receiving the received bill until a transaction is established, and money classifying recycle cassettes (also called as money classifying receiving cassettes or receiving portions) 5*a*, 5*b* and 5*c* (three money kinds in the present embodiment) receiving the bill received from the cash slot 2 or discharging the bill at a time of paying the bill per the money kind. Further, there are provided with a replenishment/retract cassette (a replenishment cassette or a retract cassette) 6 replenishing the various kinds of bills in the recycle cassette 5 per the money kind, or retracting the various kinds of bills from the recycle cassette 5, a reject cassette 7 accumulating the bill which is determined by the bill validator 3 to be impossible to be read in the money kind, the bill which is determined by the bill validator 3 to be impossible to be carried in the carried state, and the like, and a carrying path 8 connecting the various constituting elements of the bill receiving and paying apparatus 1 and carrying the bill. Further, there are provided with a memory portion data base 9 (which may be included as a function of the bill validator 3) storing a corresponding relation between the money kind and the bill size, and the like, and a control portion 10 connected via the main body control portion 106 and the bus 110, controlling the bill receiving and paying apparatus 1 in correspondence to the instruction from the main body control portion 106 and the state detection of the bill receiving and paying apparatus 1, and sending the information concerning the state of the bill receiving and paying apparatus 1 to the main body control portion as occasion demands. In this case, both of the main body control portion 106 and the control portion 10 are constituted by CPU, memory and the like, and are also called as a control portion in all.

A description will be given of an internal layout of the bill receiving and paying apparatus 1 in FIG. 3. The bill receiving and paying apparatus 1 carries the bill on the basis of a longitudinal direction of the bill because the bill receiving and paying apparatus 1 carries the bill at a high speed and handles a lot of bills. This means that the bill is carried such that the longitudinal direction of the bill is perpendicular to the carrying direction of the bill. Accordingly, the attitude of the bill is set such that the longitudinal direction of the bill is perpendicular to the receiving direction or the discharging direction of the bill, at a time of receiving the bill in the respective receiving boxes such as the receiving box 5, the replenishment/retract cassette 6 and the like from the carrying path, and discharging (delivering) the bill to the carrying path from the respective receiving boxes. In other words, the bill is carried in a short-side direction.

In this case, the bill handled by the bill receiving and paying apparatus 1 is not limited to the Japanese bills, but includes overseas bills such as Euro bills, dollar bills and the like. The Japanese bills have 10,000-yen banknote, 5,000-yen banknote, and 1,000-yen banknote (including new bills which will be issued on 2004), however, since the sizes of the bills, particularly the short-side sizes of the bills are unified to approximately 76 mm, no problem is generated in the bill delivering motion from the box. However, the Euro bills have seven kinds, in which a size of a smallest 5-Euro banknote is 62×120 mm, a size of a largest 500-Euro banknote is 82×160 mm, and a difference of 20 mm exists in the short-hand size.

Accordingly, the replenishment/retract cassette 6 receiving the plural kinds of moneys such as the overseas bills and the like in a mixed manner receives the bills in an erect position attitude as illustrated. In other words, the bills having the small size and the bills having the large size may be arranged in good order on a bottom surface of the receiving portion in the longitudinal direction of the bills, and the delivering and accumulating motions of the bills may be stably executed. On the other hand, in a type in which the bills are received in a horizontal attitude such as the receiving cassette 5, a specific mechanism for aligning the longitudinal portions of the bills is required for delivering the bills having the largely different sizes. Accordingly, there is a problem that the mechanism of the receiving cassette 5 is complicated.

Therefore, in the case of receiving the plural kinds of bills in the same receiving cassette, it is desirable to employ the receiving cassette which may received the bills in the erect position attitude such as the replenishment/retract cassette 6. In the case of one kind of bill, since the size is one, it is desirable to employ the receiving cassette receiving the bills in the horizontal attitude such as the receiving cassette 5.

Further, the recycle cassettes 5 per the money kind are arranged in parallel in the depth direction as seen from the front face of the bill receiving and paying apparatus 1. As mentioned above, since the recycle cassettes 5 are arranged in a backward and forward direction of the apparatus, the recycle cassettes per the money kinds may be additionally provided in the depth direction in accordance with the increase of the handled money kinds, such as four or five money kinds, for example, to the apparatus which may handle three kinds of moneys in FIG. 3. Since the receiving cassette is not additionally provided in the vertical direction of the apparatus, there is not generated a problem that the height of the apparatus is increased toward the upper side. In this case, since the recycle cassette 5 receives the bills in the horizontal attitude, the delivering and accumulating mechanism is attached to an upper portion of the receiving cassette, and the delivering and accumulating process of the bill is executed.

Further, the reject cassette 7 receives the bill which is not suitable for receiving or paying on the basis of the money kind and truth diagnosis by the bill validator 3 as mentioned above. Since it is necessary to take out the reject bill from the apparatus 1, the reject cassette 7 is mounted in a front face side of the recycle cassettes 5*a*, 5*b* and 5*c* as shown in FIG. 3, in view of the maintenance and operation aspect of the bill receiving and paying apparatus 1. Further, the reject cassette 7 is mounted in a lower side of a carrying path 8 (a portion denoted by reference symbol 8*a*) carrying in two ways in the vertical direction of the apparatus. It is desirable that the reject cassette 7 is structured as an aspect that two receiving portions are included, and the bill rejected within the apparatus and the bills failed to be picked up are separated. In this case, since the reject cassette 7 is required to have only the function of accumulating the bills and is not required to deliver the bills, the bills may be received either in the horizontal attitude or in the erect position attitude. However, as illustrated, the reject cassette 7 itself may be intended to be made compact by receiving one of them in the horizontal attitude and receiving the other in the erect position attitude.

The cash slot 2, the validator 3 and the temporary storing cassette 4 are arranged in an upper unit of the bill receiving and paying apparatus 1, and the respective receiving cassettes receiving the bills are arranged in a lower unit. Accordingly, it is possible to cover only the lower unit by a strong safe casing. Further, in the lower unit, the replenishment/retract cassette 6 is arranged in an upper portion of the recycle cassettes 5*a*, 5*b* and 5*c* and the reject cassette 7. As will be mentioned later, the bill delivered from the replenishment/retract cassette 6 is temporarily stored in the temporary cassette 4, and is delivered to the various recycle cassettes 5*a*, 5*b* and 5*c* in correspondence to the money kind. The bill rejected at a time of replenishing is received in a replenishment reject cassette (the receiving portion) 12 within the replenishment/retract cassette 6, not in the reject cassette 7. Since it is necessary to separate the receiving portion 12 from the replenished bills, the receiving portion 12 is mounted in a rear face side of the apparatus 1 as illustrated. In this case, since the reject bill at a time of replenishing is directly carried to the receiving portion 12 from the temporary storing cassette 4 without passing through the validator 3, it is preferable to arrange at an illustrated position which is closest to the temporary storing cassette 4. In other words, the replenishment/retract cassette 6 is mounted between the upper unit and a plurality of receiving cassettes (5*a*, 5*b* and the like).

Figure 4:
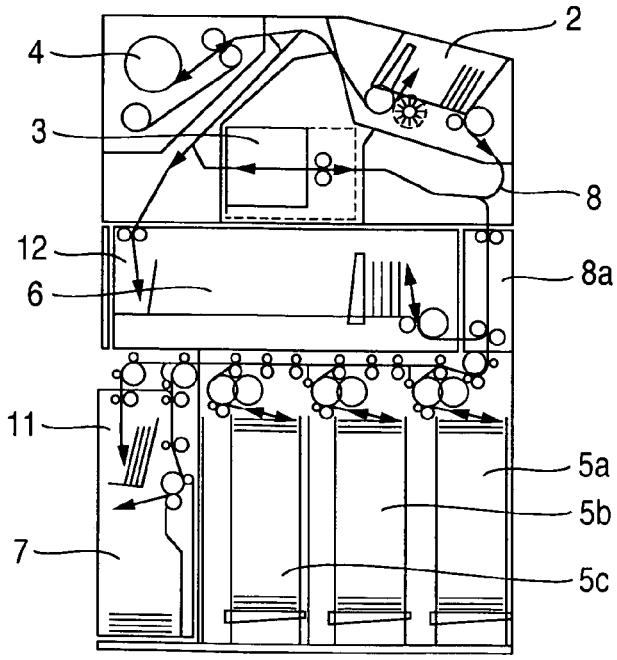
FIG. 4 is a view showing the structure of the bill receiving and paying apparatus.

Next, the bill receiving and paying apparatus 1 in FIG. 4 is different from that in FIG. 3 in a point that the reject cassette 7 is mounted in a rear face side of the recycle cassettes 5*a*, 5*b* and 5*c*. In other words, the reject cassette 7 shown in FIG. 4 is symmetrical to the reject cassette 7 shown in FIG. 3. A position of the reject cassette 7 may be freely selected by forming the recycle cassettes 5*a*, 5*b* and 5*c* existing in a lowermost stage of the apparatus 1 and the reject cassette 7 as a vertically arranged type receiving cassette, and arranging them in parallel in a backward and forward direction of the apparatus at a time of mounting. In this case, the reject cassette 7 is actually formed in the same shape.

The carrying path 8*a* is common to FIGS. 3 and 4, and is mounted in a front side of the apparatus in adjacent to the replenishment/retract cassette 6, for the purpose of carrying the bill in the two-way direction in the vertical direction and carrying the bill delivered from the replenishment/retract cassette 6 or the bill accumulated in the replenishment/retract cassette. Further, the carrying path 8*a* is structured such as to be connected to the bill receiving portion constituted by the recycle cassettes 5*a*, 5*b* and 5*c* and the reject cassette 7 and the position (the upper unit) above the replenishment/retract cassette 6 by one path.

A description will be given of taking out the replenishment/retract cassette 6 and the reject cassette 7 with reference to FIG. 5.

Figure 5:
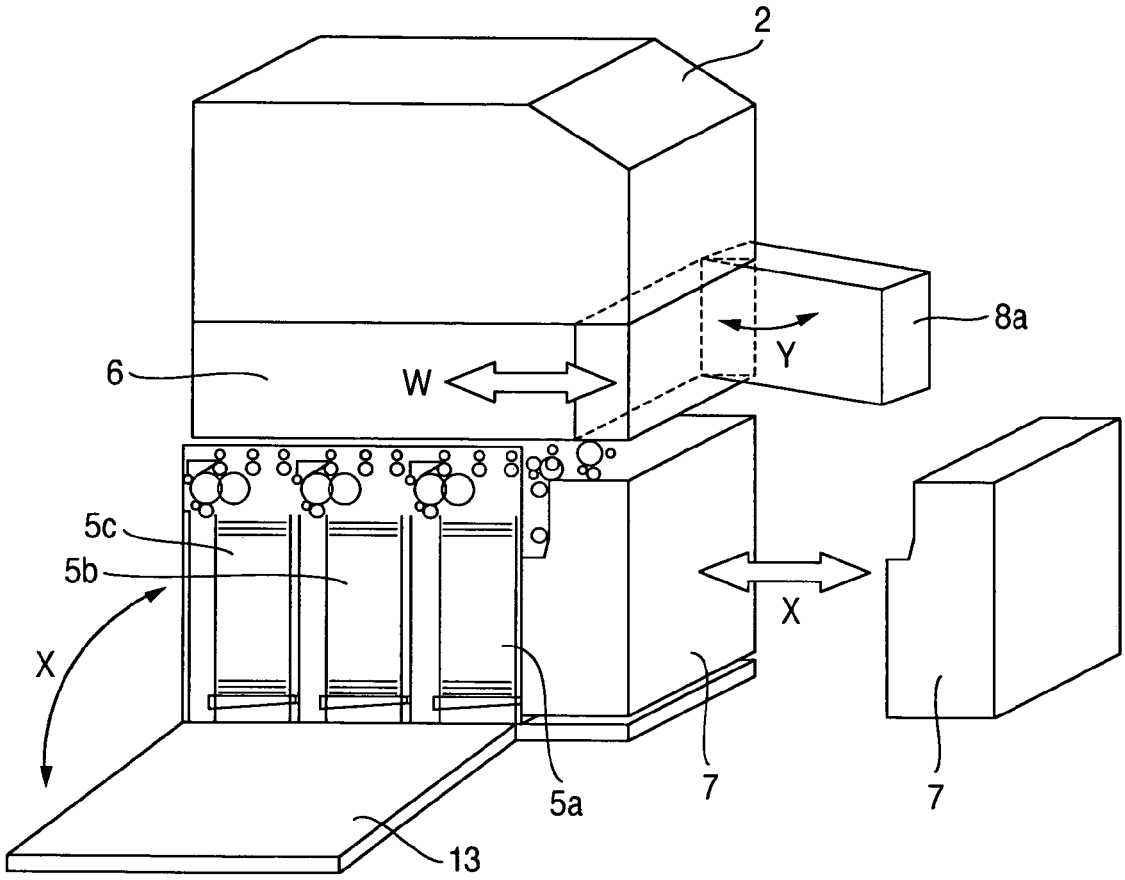
FIG. 5 is a view showing the structure of the bill receiving and paying apparatus.

In FIG. 5, since the reject cassette 7 is mounted in the front face side of the recycle cassettes 5*a*, 5*b* and 5*c* (refer to the internal layout in FIG. 3), the reject cassette 7 is attached and detached in a backward and forward direction X. In the present embodiment, in the case that the reject cassette 7 in FIG. 4 is mounted in the rear face side of the recycle cassettes 5*a*, 5*b* and 5*c* although not being illustrated, the reject cassette 7 is taken out from the rear face side. Further, a part (8*a*) of the front face side carrying path 8 of the replenishment/retract cassette 6 may be opened and closed in a direction Y, and the replenishment/retract cassette 6 may be taken out in a forward direction W from the opening and closing portion and may be set in a backward direction W. Accordingly, even in the case that a staff or a customer engineer carries out a replenishing, reloading or recovering work of the bills, the replenishment/retract cassette 8 may be attached and detached in a horizontal direction with respect to the apparatus by opening and closing only the carrying path 8*a*. In this case, in accordance with an operation aspect of the apparatus, a door which may be opened and closed is provided in a rear face of the apparatus and the replenishment/retract cassette 8 may be taken out from the rear face side. The recycle cassettes 5*a*, 5*b* and 5*c* are not taken out from the bill receiving and paying apparatus 1, and are operated and maintained by opening and closing the door 13.

The description is given mainly of the internal layout of the bill receiving and paying apparatus (the bill handling apparatus) 1 and the structure at a time of maintenance. However, a description will be given next of the various processes such as the bill receiving, the bill paying and the like by the present apparatus. In this case, the structure in FIG. 3 is used as the internal layout, and a control thereof is executed by a main body control portion 106 in FIG. 2, and a control portion 10 in FIG. 6 (which may be also called as a control portion, a control unit or a control means in combination).

Figure 7:
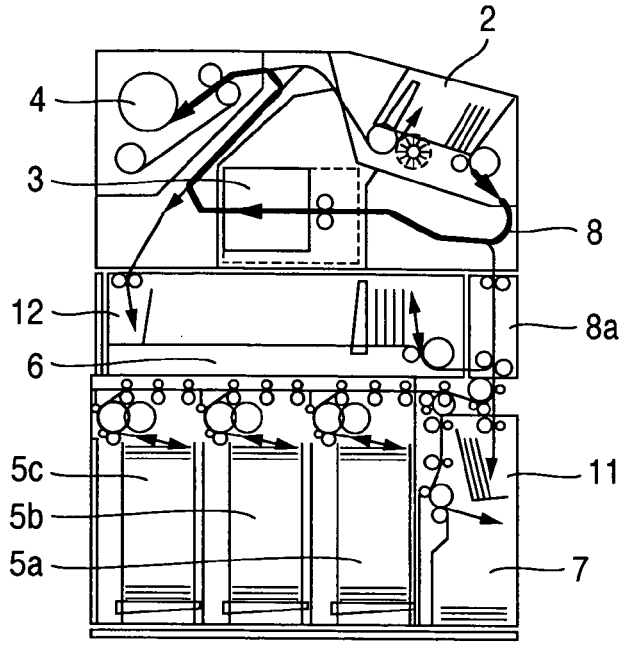
FIG. 7 is a view showing a cash receiving motion in accordance with the present embodiment.
Figure 8:
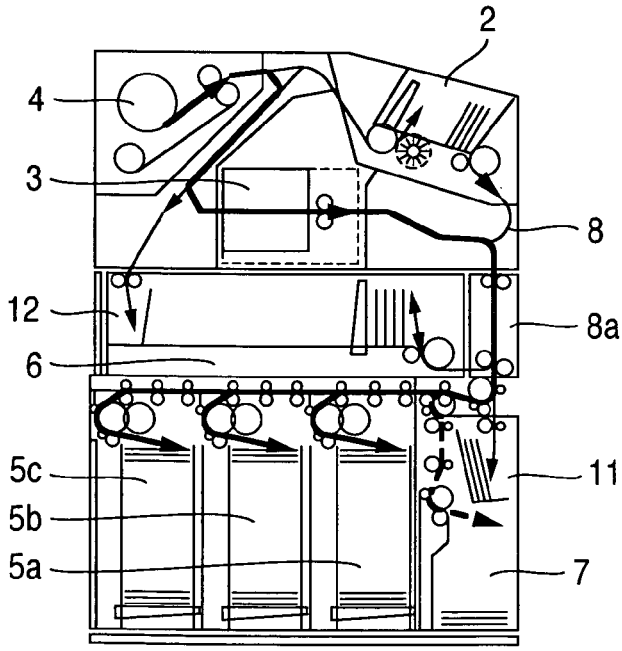
FIG. 8 is a view showing the cash receiving motion in accordance the present embodiment.
Figure 9:
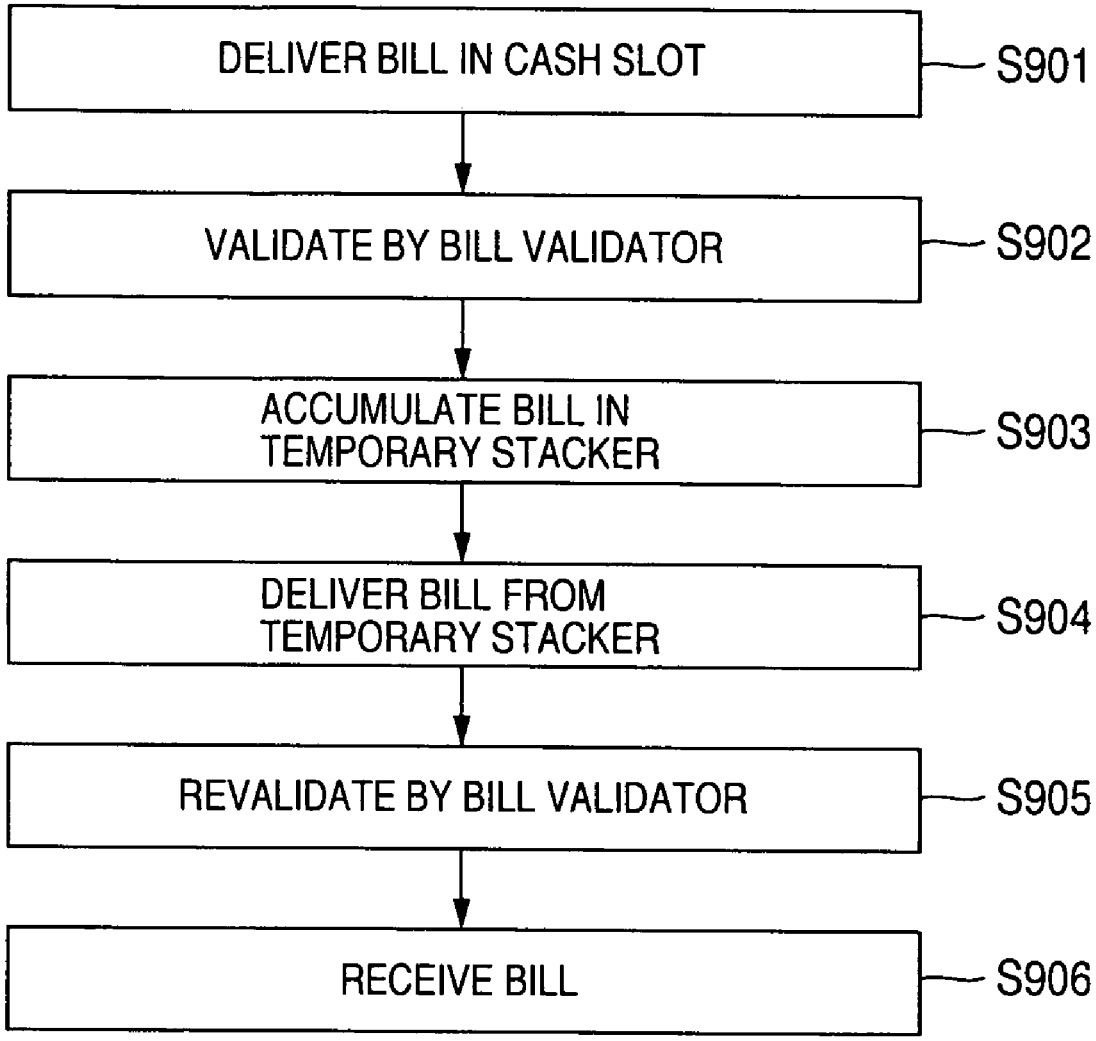
FIG. 9 is a flow chart of the cash receiving motion in accordance with the present embodiment.

A description will be given of a cash receiving motion of the present embodiment with reference to FIGS. 7 to 9. FIG. 7 shows a cash counting process, and FIG. 8 shows a cash receiving process.

The user puts one bill or a plurality of bills in the cash slot 2. The cash slot 2 delivers the charged bill to the carrying path 8 in the inner portion of the apparatus by closing a shutter and separating the charged bill by a separating and delivering mechanism placed in the inner portion of the cash slot (a step 901). The bill delivered to the carrying path 8 is carried in a direction of an arrow in the drawing and is determined by the bill validator 3 with respect to the money kind, the number, the truth and the like (a step 902), and is simultaneously defined so as to be temporarily received in the temporary stacker 4 (a step 903). At this time, the bill rejected by the validator 3 is not received in the temporary stacker 4, but is returned to the cash slot 2. The process up to here is called as a cash count process.

Subsequently, a total amount calculated on the basis of the money kind and the number determined by the bill validator 3 is displayed on a user operating portion 105, and the user confirms on the user operating portion 105 that the total amount is equal to the charged bills. The bills temporarily received in the stacker 4 is delivered as shown in FIG. 8, after detecting a push-down operation of a confirmation key displayed on the operating portion 105 and settling the amount (a step 904). The bills delivered to the carrying path 8 are carried in a direction of an arrow in FIG. 8, and are determined by the bill validator 3 with respect to the bill state or the like (a step 905). At this time, the reject bill which is not read on the money kind, may not be normally carried, or is determined to be unsuitable for the paid bill is received in the reject cassette 7. The bill determined to be normal, is received in the recycle cassettes 5*a*, 5*b* and 5*c* in correspondence to the money kind (a step 906).

Figure 11:
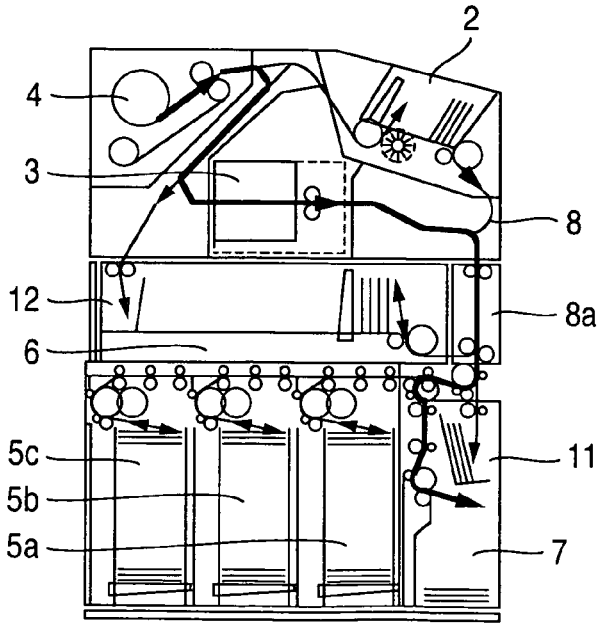
FIG. 11 is a view showing the cash paying motion in accordance with the present embodiment.
Figure 12:
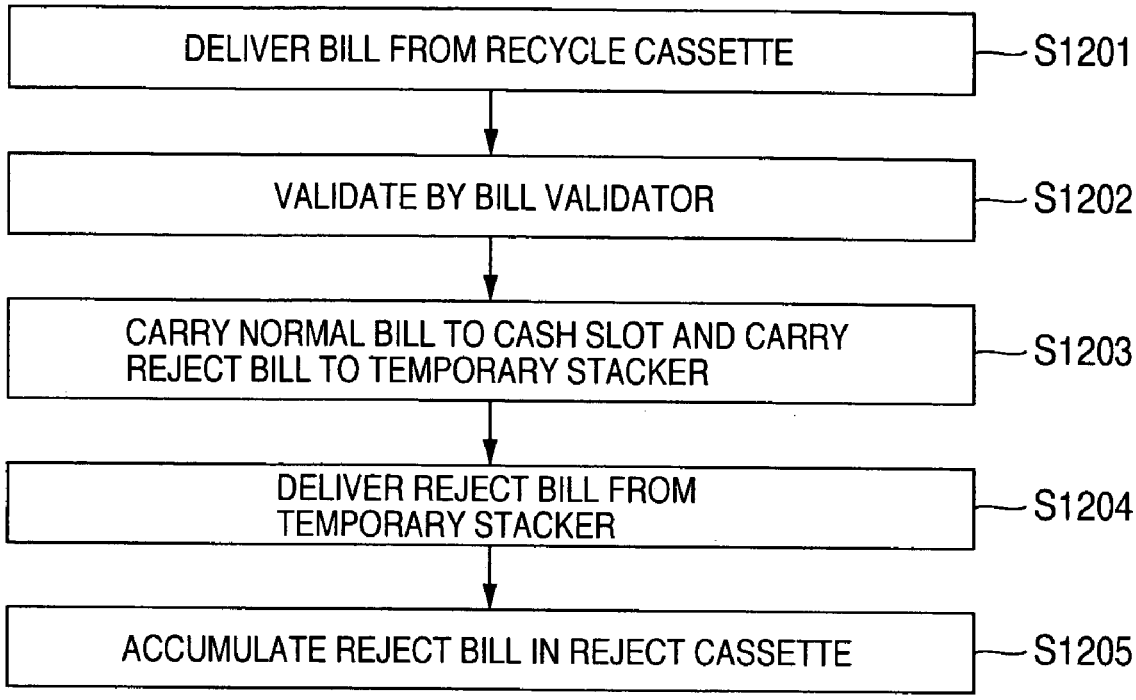
FIG. 12 is a flow chart of the cash paying motion in accordance with the present embodiment.

Next, a description will be given of a money paying motion in accordance with the present embodiment with reference to FIGS. 10 to 12.

Figure 10:
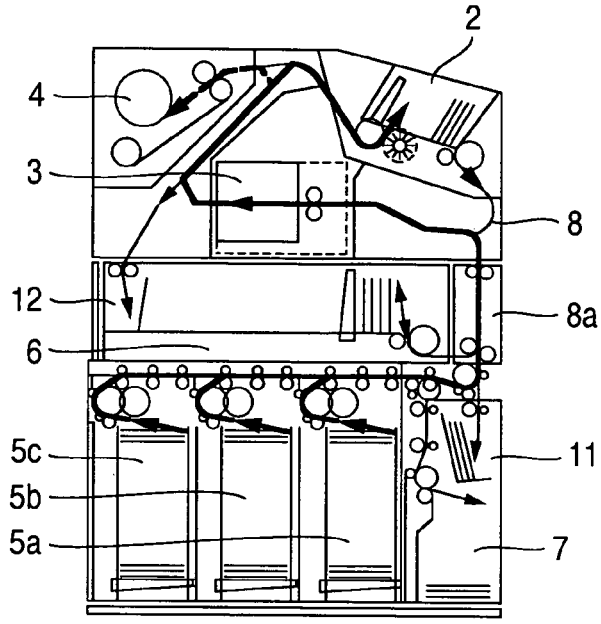
FIG. 10 is a view showing a cash paying motion in accordance with the present embodiment.

In the case that the user defines the operation after inputting the paid amount in the user operating portion 105, the bills to be paid in correspondence to the money kind and the number of the operated desired amount are delivered to the carrying path 8 in the bills received in the recycle cassettes 5*a*, 5*b* and 5*c*, as shown in FIG. 10 (a step 1201). Subsequently, the bills delivered to the carrying path 8 is determined by the bill validator 3 with respect to the money kind, the number, the carried state and the like (a step 1202). The bill which may not be validated is carried to the temporary stacker 4 so as to be temporarily stored, and the normally validated bill is carried to the cash slot 2 and accumulated (a step 1203). The reject bill stored in the temporary stacker 4 is delivered in the vicinity of the motion that the user takes out the paid bill from the cash slot 2 (a step 1204), and is accumulated in the reject cassette 7 via the carrying path 8 as shown in FIG. 11 (a step 1205). In this case, the bill which the user forgets to take out from the cash slot after being paid is accumulated in a forgot bill retract cassette 11 for exclusively accumulating the forgot bill.

Figure 14:
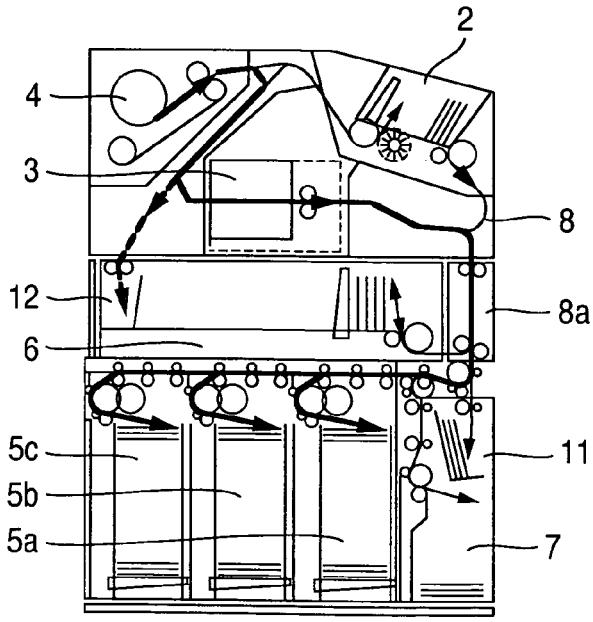
FIG. 14 is a view showing the bill replenishing motion in accordance with the present embodiment.
Figure 15:
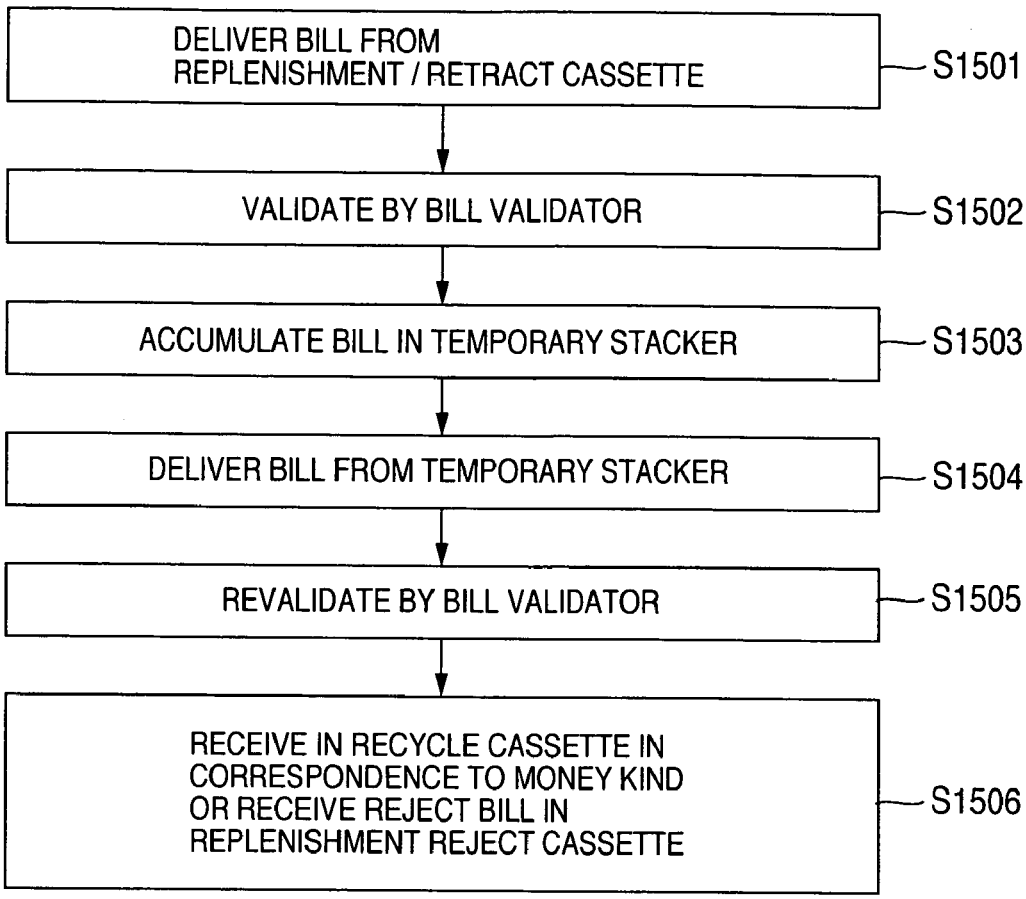
FIG. 15 is a flow chart of the bill replenishing motion in accordance with the present embodiment.

Next, a description will be given of a replenishing motion in accordance with the present embodiment with reference to FIGS. 13 to 15. The replenishing motion is carried out, for example, in the case that the bills are replenished within the apparatus before activating the automatic teller machine 101 or in the case that the bills are replenished within the apparatus at a time when the number of the bills within the apparatus is reduced during the operation. In the replenishing motion, the replenishment/retract cassette 6 is first attached to the bill receiving and paying apparatus 1. The replenishment/retract cassette 6 is attached to the bill receiving and paying apparatus 1 by opening and closing a part (8*a*) of the front face side carrying path 8 of the replenishment/retract cassette 6 forming the carrying path at a time of the normal operation. Of course, it may be replenished from the rear face side in accordance with the maintenance aspect and the operation aspect of the bill receiving and paying apparatus 1.

Figure 13:
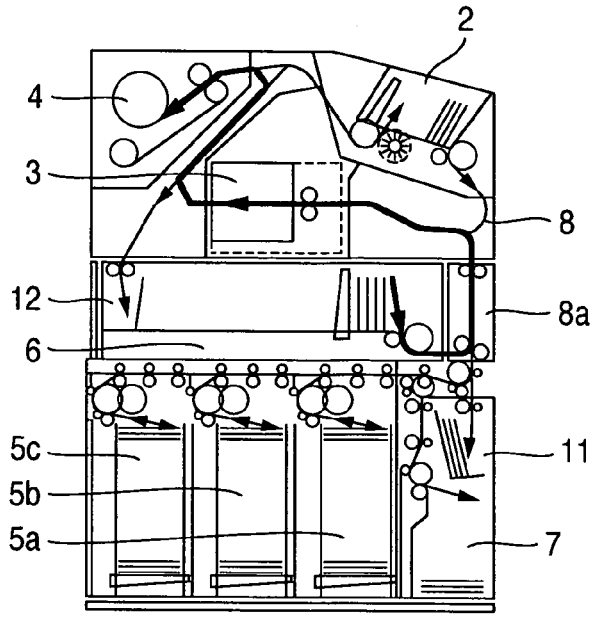
FIG. 13 is a view showing a bill replenishing motion in accordance with the present embodiment.

The customer engineer, the bank clerk or the like attaches the replenishment/retract cassette 6 within the apparatus after manually receiving the bills having the mixed money kinds in the replenishment/retract cassette 6, and pushes down, for example, a replenishment key, the bills received in the replenishment/retract cassette 6 are delivered as shown in FIG. 13 (a step 1501). The delivered bills are validated by the bill validator 3 with respect to the money kind, the number, the bill state and the like (a step 1503). In this case, a predetermined number means a limit number which may be accumulated in the temporary stacker 4, for example, about 200 sheets. Subsequently, as shown in FIG. 14, the bill is delivered from the temporary stacker 4 (a step 1504). At this time, the reject bill validated in the step 1503 as the bill which may not be validated and the defiled bill is received in a replenishment reject cassette 12 provided within the replenishment/retract cassette 6 before passing through the validator as shown by a dotted arrow. On the other hand, the bill which is determined in the step 1503 as the normal bill is again validated by the validator 3 with respect to the money kind and the like (a step 1505), and is received in the recycle cassettes 5*a*, 5*b* and 5*c* per the money kind in correspondence to the validation result (a step 1506). In this case, the bill which is once determined in the step 1503 as the normal bill is determined in the step 1505 as the reject bill, returned to the replenishment/retract cassette 6 and received. As mentioned above, in the replenishing process, since the temporary stacker 4 has the limit number, all the bills received in the replenishment/retract cassette 6 may not be delivered at a time on the basis of only one replenishing process. Because the bill amount received in the replenishment/retract cassette is normally more than the bill amount temporarily stored in the temporary stacker. Accordingly, the bills which are once returned to the replenishment/retract cassette 6 are delivered at a time of the second or third replenishing process, that is, the step 1501 on and after are repeated, and thereafter, are received in the replenishment reject cassette 12 or the recycle cassette 5.

Figure 16:
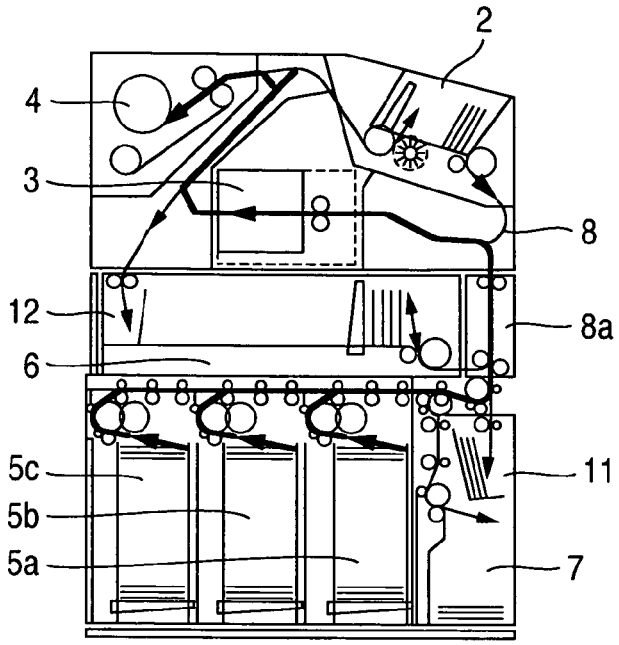
FIG. 16 is a view showing a bill retracting motion in accordance with the present embodiment.
Figure 17:
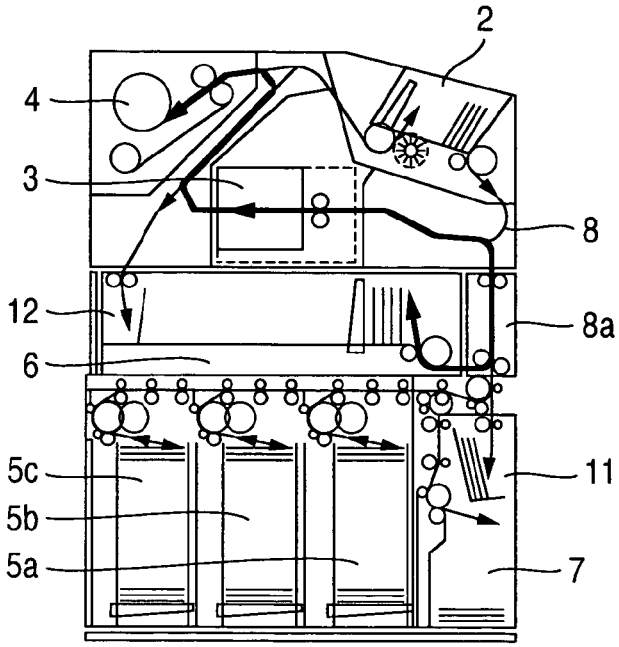
FIG. 17 is a view showing the bill retracting motion in accordance with the present embodiment.
Figure 18:
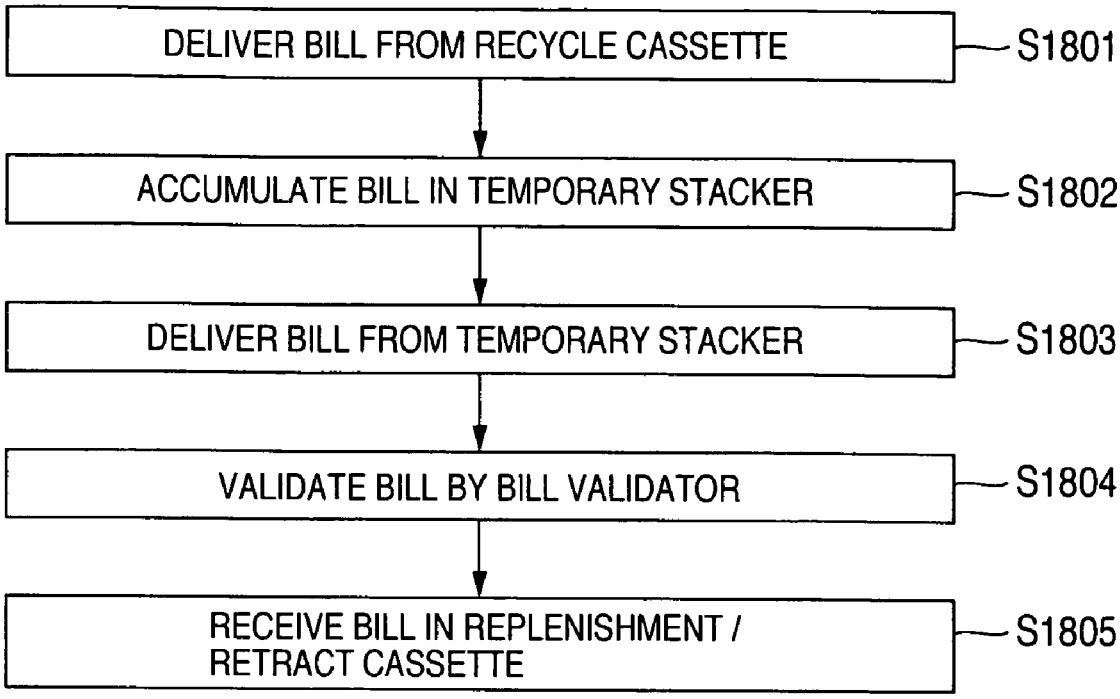
FIG. 18 is a flow chart of the bill retracting motion in accordance with the present embodiment.

A description will be given of a retracting motion in accordance with the present embodiment with reference to FIGS. 16 to 18. The bill retracting motion is carried out in the case that a necessity for retracting the bill within the automatic teller machine 101 is generated, for example, the case the bill within each of the recycle cassettes 5*a*, 5*b* and 5*c* within the automatic teller machine 101 is retracted after the end of business, the case of preventing the apparatus from being down due to the full of the recycle cassettes 5*a*, 5*b* and 5*c* on the basis of the increase of the number of the bills received in the recycle cassettes 5*a*, 5*b* and 5*c* during the operation, and the like. As shown in FIG. 16, after the bills received in the recycle cassettes 5*a*, 5*b* and 5*c* are delivered (a step 1801), the bills are accumulated in the temporary stacker 4 (a step 1802). At this time, the bills are carried via the validator 3, however, since the bills received in the recycle cassette are the correct bills which have been already defined with respect to the money kind, the number and the like, the bill validation is not executed in the validator. Subsequently, as shown in FIG. 17, the bill is delivered from the temporary stacker 4 (a step 1803), the bill is validated by the validator with respect to the money kind and the like (a step 1804), and the bill is retracted to the replenishment/retract cassette 6 via the carrying path 8 (a step 1805). The reject bill by the validator 3 in the step 1805 is received in the reject cassette 7. After finishing the retracting work, the retracting motion is completed by detaching the replenishment/retract cassette 6 from the bill receiving and paying apparatus 1. The retracting process is executed at a plurality of times until the bill in the recycle cassette 5 is empty or until the bill in the replenishment/retract cassette is full.

The reject bill is retracted by detaching the reject cassette 7 as it is. The reject cassette 7 may be detached in correspondence to the maintenance aspect and the operation aspect of the apparatus, such that the reject cassette 7 is detached from the front face side in the case that the reject cassette 7 is mounted in the front face side of the recycle cassettes 5*a*, 5*b* and 5*c* as shown in FIG. 3 mentioned above, or the reject cassette 7 is detached from the rear face side in the case that the reject cassette 7 is mounted in the rear face side of the recycle cassettes 5*a*, 5*b* and 5*c* as shown in FIG. 4.

Further, it is possible to count the bill number within the automatic teller machine 101 by continuously the retracting motion and the replenishing motion mentioned above in each of the recycle cassettes 5*a*, 5*b* and 5*c* without attaching and detaching the replenishment/retract cassette 6 to and from the bill receiving and paying apparatus 1.

Embodiment 2

Figure 19:
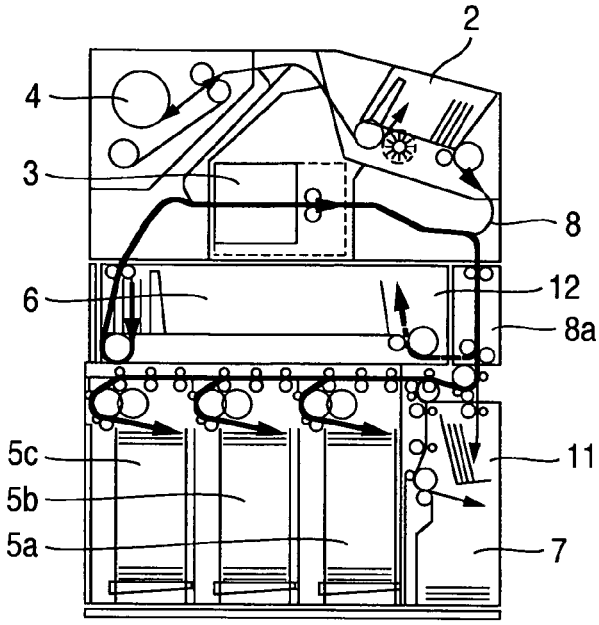
FIG. 19 is a view showing a bill replenishing motion in accordance with the other embodiment of the present invention.
Figure 20:
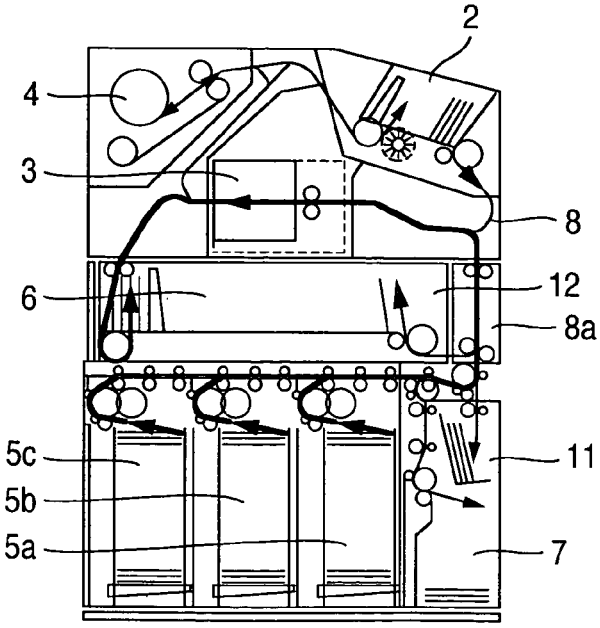
FIG. 20 is a view showing the bill replenishing motion in accordance with the other embodiment of the present invention.

Next, a description will be given of a second embodiment in accordance with the present technique. In the second embodiment, as shown in FIGS. 19 and 20, a portion for delivering or accumulating the bills within the replenishment/retract cassette 6 is arranged in a rear face side of the apparatus. In addition, branching from the first carrying path connecting the temporary stacker 4 and the recycle cassette 5, a second carrying path connecting the branch point and the bill delivering and accumulating portion of the replenishment/retract cassette 6 is provided, and the second carrying path is structured such as to freely carry the bill in two-way direction.

As is known from the first embodiment, since the first carrying path (a part of the carrying path 8) connecting the temporary stacker 4 and the recycle cassette 5 carries the bill in the two-way direction, the carrying path structure of the entire of the apparatus is simple, and there is an effect that the jam generation of the bill is reduced at that degree. On the other hand, as is illustrated in FIGS. 3 and 4, in the case that the bill delivering or accumulating portion of the replenishment/retract cassette 6 is arranged along the first carrying path, the bill is temporarily stored in the temporary stacker 4 in the replenishing and retracting process and motion explained in FIGS. 13 to 18. Accordingly, it is necessary to repeat the replenishing and retracting motion at a plurality of times in correspondence to the bill amount for the temporary storing, and a lot of time is required. This is because the money kind, the number, and the carried state and the like are validated by the validator 3, and the carrying path is structured such as to freely carry in the two-way direction.

In the second embodiment, there is shown the apparatus layout which may shorten the time for the replenishing or retracting process, by omitting the bill temporary storing process in the temporary stacker 4.

FIG. 19 shows the process and motion for replenishing (including reloading) the bill in the recycle cassette 5. In the replenishing process and motion, after the bill is delivered from the bill delivering portion of the replenishment/retract cassette 6, the bill is carried to the first carrying path from the second carrying path, and is validated in the bill validator 3 with respect to the money kind, the carried state and the like. Subsequently, the bill is accumulated in the recycle cassettes 5*a*, 5*b* and 5*c* in each of the money kinds in correspondence to the validation result of the bill in the validator 3, without being temporarily accumulated in the temporary stacker 4. As mentioned above, since the replenishing process is executed without passing through the temporary stacker 4, it is possible to continuously replenish all the bills without temporarily stopping the delivering motion from the replenishment/retract cassette 6.

FIG. 20 shows the retracting process and motion of the bill from the recycle cassette 5. When the retracting process is operated, the bill is delivered from the recycle cassettes 5*a*, 5*b* and 5*c* per the respective money kinds, the money kinds and the like are validated in the bill validator 3 on the first carrying path, the bill is thereafter carried to the second carrying path, the bill is directly accumulated in the inner portion by the bill accumulation portion within the replenishment/retract cassette 6, and the bill is retracted. In this case, since the temporary stacker 4 does not intervene, the replenishing process may be continuously executed until the replenishment/retract cassette 6 is filled with the received bills, or until the bill in the recycle cassette 5 becomes empty.

In this case, in the case that the reject bill is detected by the validator 3 in the replenishing process in FIG. 19, the reject bill is carried and accumulated within the replenishment reject cassette 12 shown by a dotted line. The reject bill in the retracting process in FIG. 20 is temporarily stored in the temporary stacker 4, and the temporarily stored reject bill is received in the reject cassette 7 after the retracting motion is finished.

As described above, in accordance with the present technique, the recycle cassettes 5*a*, 5*b* and 5*c* are arranged in parallel in the depth direction as seen from the front face of the bill receiving and paying apparatus 1, and the replenishment/retract cassette 6 is arranged in the vertically laminating direction with respect to the recycle cassettes 5*a*, 5*b* and 5*c* and the reject cassette 7. Accordingly, it is possible to freely add the recycle cassette 7 in correspondence to the increase of the money kind without being affected by the limitation in the height direction of the cash slot 2. Further, since the reject cassette 7 is arranged in parallel in the depth direction as seen from the front face f the bill receiving and paying apparatus 1 in the same manner as the recycle cassettes 5*a*, 5*b* and 5*c*, the reject cassette 7 may be set to a large capacity without being affected by the capacity limitation due to the limitation in height of the cash slot 2. Accordingly, it is possible to prevent the apparatus from being down due to the full state of the reject cassette 7. Further, since the reject cassette 7 may be arranged in the front face side or the rear face side of the recycle cassettes 5*a*, 5*b* and 5*c* in correspondence to the operation/maintenance aspect of the apparatus, and the shape of the reject cassette shown in FIG. 4 and the shape of the reject cassette shown in FIG. 3 are formed in the same shape while being symmetrical, it is possible to apply to either of the apparatuses, and it is possible to provide the apparatus having the improved apparition operation and the improved maintenance efficiency. Further, since the replenishment/retract cassette 6 has the horizontally arranged type structure, and the bill carrying path 8*a* arranged in the front side of the replenishment/retract cassette 6 may be opened and closed, the structure may be made such as to be attached to and detached from the front face of the replenishment/retract cassette 6, and the apparatus operability and maintenance characteristic are improved. Further, the bill receiving portion constituted by the recycle cassettes 5*a*, 5*b* and 5*c* and the reject cassette 7 and the carrying path 8 have the structure connected by one carrying path, a possibility that the jam is generated is lowered, and even if the jam is generated, a good jam removing performance may be obtained, and the time required for repairing the jam is reduced, whereby the apparatus having the improved maintenance characteristic may be provided. Of course, it goes without saying that the apparatus may be made compact on the basis of the short carrying path.

Further, in accordance with the second embodiment, since the temporary accumulation in the temporary stacker is not carried out at a time of the replenishing and retracting motion, it is possible to intend to shorten the operating time, and it is possible to intend to shorten the replenishing and retracting operating time in the apparatus handling a lot of money kinds.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A bill receiving and paying apparatus for receiving and paying out of a bill comprising:

a cash slot for paying out or receiving the bill;

a bill validator validating the bill;

a temporary storing portion temporarily storing the bill;

a plurality of recycle cassettes per money kinds receiving or discharging the bill;

a replenishment/retract cassette replenishing the bill to the recycle cassette or retracting the bill from the recycle cassette;

a reject cassette receiving the bill which is impossible to be validated by the bill validator; and a carrying path carrying the bill, wherein the recycle cassette have a vertically arranged structure accumulating the bill in a horizontal attitude, wherein the replenishment/retract cassette has a horizontally arranged structure accumulating the bill in an erected position attitude, wherein the recycle cassette and the reject cassette are arranged in parallel in a depth direction from a front face of the apparatus, and wherein the replenishment/retract cassette is arranged in an upper portion of the recycle cassettes and the reject cassette and in a lower portion of the validator.

2. A bill receiving and paying apparatus as claimed in claim 1, wherein the replenishment/retract cassette has a delivering or accumulating mechanism delivering or accumulating the bill, and the delivering or accumulating mechanism of the replenishment/retract cassette is arranged along the carrying path provided in the front face side of the apparatus.

3. A bill receiving and paying apparatus as claimed in claim 1, further comprising:

a control portion, wherein the control portion executes a bill receiving process of validating the bill received in the cash slot by the bill validator, returning a non-validated bill which is a reject bill to the cash slot on the basis of the validation result, storing a validated bill in the temporary storing portion, thereafter delivering the bill stored in the temporary storing portion so as to again validate in the bill validator, receiving the bill to a recycle cassette corresponding to the money kind of the revalidation result, and receiving a non-validated bill as the reject bill on the basis of the revalidation result in the reject cassette.

4. A bill receiving and paying apparatus as claimed in claim 1, further comprising:

a control portion, wherein the control portion executes a bill paying process of delivering the bill received in the recycle cassette as to validate in the bill validator, storing a non-validated bill in the temporary storing portion on the basis of the validation result, accumulating a validated bill in the cash slot, and thereafter delivering the bill stored in the temporary storing cassette to the reject cassette.

5. A bill receiving and paying apparatus as claimed in claim 2, further comprising:

a control portion, wherein the control portion executes a replenishing process of delivering the bill received in the replenishment retract cassette by the delivering mechanism, validating the bill in the validator so as to store the validated bill in the temporary storing portion, and thereafter delivering the bill stored in the temporary storing portions to the recycle cassette corresponding to the money kind so as to receive the bill therein.

6. A bill receiving and paying apparatus as claimed in claim 5, wherein the control portion repeatedly executes the replenishing process at a plurality of times after receiving the bill in the recycle cassette.

7. A bill receiving and paying apparatus as claimed in claim 5, wherein the bill which is validated as the reject bill by the bill validator, is received in a replenishment reject cassette provided within the replenishment/retract cassette.

8. A bill receiving and paying apparatus as claimed in claim 2, further comprising:

a control portion, wherein the control portion executes a retracting process of delivering the bill received in the recycle cassette so as to store the bill in the temporary storing portion, thereafter delivering the bill stored in the temporary storing portion so as to validate the bill by the bill validator and to deliver the bill to the accumulating mechanism of the replenishment/retract cassette.

9. A bill receiving and paying apparatus as claimed in claim 8, wherein the control portion repeatedly executes the retracting process at a plurality of times after receiving the bill in the replenishment retract cassette.

10. A bill receiving and paying apparatus as claimed in claim 8, wherein the bill which is validated as the reject bill by the bill validator, is received in the reject cassette.

11. A bill receiving and paying apparatus as claimed in claim 1, wherein the reject cassette is arranged in a front face side or a rear face side of the plurality of recycle cassettes.

12. A bill receiving and paying apparatus as claimed in claim 1, wherein a part of the carrying path arranged in the front face side of the replenishment/retract cassette is structured such as to be freely opened and closed, and the replenishment/retract cassette is structured such as to be detachable in a horizontal direction with respect to the apparatus in a state in which a part of the carrying path is open.

13. A bill receiving and paying apparatus as claimed in claim 1, wherein the carrying path connecting the temporary storing cassette and the recycle cassette carries the bill in a two-way direction via the bill validator.

14. A bill receiving and paying apparatus as claimed in claim 1, wherein the replenishment/retract cassette has a delivering or accumulating mechanism delivering or accumulating the bill, and the delivering or accumulating mechanism of the replenishment/retract cassette is arranged in a rear face side of the apparatus opposing to the carrying path provided in the front face side of the apparatus.

15. A bill receiving and paying apparatus as claimed in claim 14, wherein a second carrying path from the delivering or accumulating mechanism of the replenishment/retract cassette to a position connected to the first carrying path connecting the temporary storing portion and the bill validator is structured such as to carry the bill in a two-way direction.

16. A bill receiving and paying apparatus as claimed in claim 14, further comprising:

a control portion, wherein the control portion executes a replenishing process of delivering the bill received by the delivering mechanism of the replenishment/retract cassette, and receiving the bill in the recycle cassette corresponding to the money kind in accordance with the result validated by the bill validator.

17. A bill receiving and paying apparatus as claimed in claim 16, wherein the bill which is validated as the reject bill by the bill validator, is received in a replenishment reject cassette provided within the replenishment/retract cassette.

18. A bill receiving and paying apparatus as claimed in claim 14, further comprising:

a control portion, wherein the control portion executes a retracting process of delivering the bill received in the recycle cassette and receiving the bill within the replenishment/retract cassette by the accumulating mechanism of the replenishment/retract cassette after being validated by the bill validator.

19. A bill receiving and paying apparatus as claimed in claim 18, wherein the bill which is validated as the reject bill by the bill validator, is received in the reject cassette.

* * * * *